US012527999B2

(12) United States Patent
Mrozowski

(10) Patent No.: US 12,527,999 B2
(45) Date of Patent: Jan. 20, 2026

(54) ROBOT AND A METHOD FOR SETTING GOLF BALLS

(71) Applicant: TeesyTek AG, Baar (CH)

(72) Inventor: Adam Mrozowski, Oława (PL)

(73) Assignee: TeesyTek AG, Baar (CH)

( * ) Notice: Subject to any disclaimer, the term of this patent is extended or adjusted under 35 U.S.C. 154(b) by 170 days.

(21) Appl. No.: 18/393,906

(22) Filed: Dec. 22, 2023

(65) Prior Publication Data

US 2024/0359074 A1 Oct. 31, 2024

(30) Foreign Application Priority Data

Apr. 28, 2023 (EP) ..... 23461570

(51) Int. Cl.
*A63B 57/00* (2015.01)

(52) U.S. Cl.
CPC ..... *A63B 57/0006* (2013.01)

(58) Field of Classification Search
CPC ..... A63B 57/0006
See application file for complete search history.

(56) References Cited

U.S. PATENT DOCUMENTS 5,282,628 A * 2/1994 Komori ..... A63B 47/002 473/136
5,351,964 A * 10/1994 Kruger ..... A63B 57/0006 473/132
5,529,307 A * 6/1996 Chang ..... A63B 57/0006 473/137
5,611,737 A * 3/1997 Rau ..... A63B 57/0006 473/133
5,860,870 A * 1/1999 Park ..... A63B 57/0006 473/136
7,018,300 B2 * 3/2006 Paicos ..... A63B 57/0006 473/135
2015/0018109 A1 * 1/2015 Goebel ..... A63B 47/002 473/137
2019/0105547 A1 * 4/2019 Wyeth ..... A63B 69/3623

FOREIGN PATENT DOCUMENTS

GB 2381464 A * 5/2003 ..... A63B 57/0006
KR 102286727 B1 * 8/2021 ..... G06V 10/40
KR 20220103231 A * 7/2022 ..... A63B 24/0021

* cited by examiner

*Primary Examiner* — Steven B Wong

(74) *Attorney, Agent, or Firm* — Ziegler IP Law Group LLC.

(57) ABSTRACT

A robot with a movable arm capable to drawing golf balls and setting them on a tee at the player's stand. The robot is for setting golf balls and includes an arm, a head which is connected to the arm, a controller. On the head a gripping element is arranged which is intended to grip golf balls, and the controller is equipped with a software to enable conveying a golf ball to an indicated position. The embodiments also provide a method for setting golf balls.

12 Claims, 1 Drawing Sheet

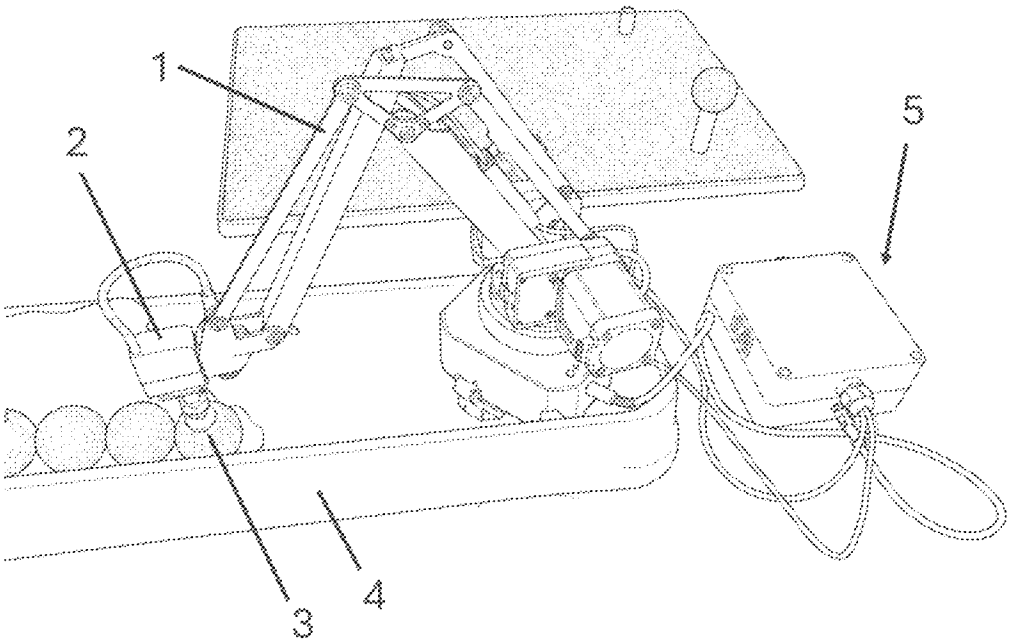
1
2
3
4
5

ROBOT AND A METHOD FOR SETTING GOLF BALLS

FIELD

The aspects of the disclosed embodiments pertain to the field of mechanic robots. More specifically, the aspects of the disclosed embodiments provide a robot with a movable arm suitable for drawing golf balls and setting them at the stand of a player.

PRIOR ART

In the prior art there are known solutions in which the user manually provides a golf ball to the stand of the player. Gravitation-based solutions are known which consist on putting a golf ball into a basket with balls and pressing a button to release a lock. The ball descends along a guide to the ground to the site where a tee for the ball is positioned.

US document U.S. Pat. No. 5,665,004 discuses an automatic dispenser of golf balls in which the user has to release the lock manually to enable gravitational falling of the ball.

Mechanical (gravitation-based) solutions in which the user manually releases a lock have several disadvantages. Preparation of the player for the stroke takes about 20-30 seconds and the stroke itself 0.5 seconds. After each stroke the player has to change position or put the club aside to press the lock button and this takes the same time as manual positioning of the ball on the tee. Gravitation-based solutions need to be integrated with a ball feeder which has large dimensions. The user has not physical room in a training hall to carry large-sized equipment. Numerous golf players worldwide are middle-aged or are more than 60. In their majority they are not able to bend and squat continually to grab the balls.

BRIEF DESCRIPTION

The aspects of the disclosed embodiments provide a robot to automate the process for setting golf balls and at the same time for streamlining playing golf.

According to the aspects of the disclosed embodiments, a robot is provided for setting golf balls, the robot comprising an arm, a head connected to the arm, a controller, characterizing in that on the head a gripping element is arranged capable to grip golf balls, and the controller is provided with a software to enable movement of the golf ball into an indicated position.

Preferably, the arm has at least two articulated joints.

In one embodiment, the gripping element is a gripper or a suction element, preferably a silicone one.

Preferably, it comprises determining means which are configured to determine whether the ball set on a tee has been hit.

The determining means is a set of lasers intended to create a 3D space of the surroundings.

In another embodiment in practice the set of lasers is configured to be oriented automatically towards the golf ball.

The set of lasers is provided on the arm.

In one embodiment, the determining means is a camera.

Preferably, the camera is configured to determine when the golf ball on the tee is hit.

In another embodiment, in practice, the robot is provided with a second camera which is intended to monitor a movement of a player.

In another embodiment, it comprises a container intended to store golf balls, preferably on which the arm is secured.

The container gravitationally forces golf balls to a site of delivery from which they may be drawn by the arm.

According to the invention, a method for setting golf balls by means of a robot is provided, said method comprising the following steps:

a) configuring at least once an initial position A from which the robot draws a golf ball and a final position B where the robot sets the golf ball, b) raising, by the robot, of a golf ball from the initial position A by means of a gripping element, c) conveying, by the robot, the golf ball to the final position B to force the golf ball out of the gripping element.

Preferably, step a) of configuring of the initial position A and the final position B is carried out through recording a movement of an arm moved by the user.

In another embodiment, step a) of configuring of the initial position A and the final position B is carried out automatically, by means of at least one camera and through analysing of an obtained image by a resident software.

In one embodiment, step a) of configuring of the initial position A and the final position B is carried out automatically by a set of lasers or cameras to create a 3D image of the surroundings of the robot, and through analysing of an obtained image by a resident software.

Preferably, after step c) step d) is performed of analysing play of a player by means of a set of lasers and a second camera and obtaining results of an analysis of the golf ball stroke.

Advantageous Effects

The aspects of the disclosed embodiments as presented enables elimination of user bending and squatting to set the balls manually on tees after each stroke. The user gains more time for training. The aspects of the disclosed embodiments automatically serves balls and thus the user, after each stroke, may make further ones without necessity to make technical breaks. The aspects of the disclosed embodiments has small dimensions and is lightweight and due to this it is easily portable. Robot may be magnetized easily. The affixed QR codes quickly redirect the user to the payment gate and the robot is activated only after payment is done.

BRIEF DESCRIPTION OF THE DRAWING

The aspects of the disclosed embodiments will be presented in more detail in a preferable embodiment with reference to the attached drawing in which:

FIG. 1—shows a robot for setting balls.

DETAILED DESCRIPTION OF A PREFERABLE EMBODIMENT

A robot for setting golf balls is applicable in training halls where users practice playing golf.

The robot for setting golf balls is constructed of an arm 1 and a head 2, as shown in FIG. 1. The head 2 is connected to the arm 1. This connection in different embodiments may be movable or articulated. The arm 1, in another embodiment, may have at least two articulated joints. The robot is also equipped with a controller 5. In one embodiment, the robot comprises a container 4, shown in FIG. 1, which is arranged for storing golf balls. Preferably, the arm 1 is mounted thereon. In another embodiment, the container 4, due to its gravitational shape, forces golf balls to a site of delivery from where they may be drawn by the arm 1. The robot, preferably, is battery-powered and on another variant it may be powered from power grid.

On the head 2 there is a gripping element 3 arranged to catch golf balls in the vicinity thereof, preferably in the container 4, and to convey them to a tee for a ball. Upon setting the ball on the tee, the arm 1 retracts and a player may strike the ball with his/her golf club. Preferably, the ball gripping element 3 is a suction element made of a silicon material, as shown in FIG. 1. In other embodiments, the gripping element 4 is a gripper which is capable to grip the round golf ball and transfer it in the air from one point to another one. The robot, preferably, is independent from any containers or trays for golf balls. Preferably, the robot may be positioned at any container 4 or tray and may cooperate with them.

The controller 5 of the robot for setting golf balls is provided with a software suitable to enable automatic conveying of the golf ball by means of the robot from an indicated site, preferably the container 4, to a desired position.

In one embodiment the robot comprises determining means which are configured to determine whether a ball set on the tee has been hit. This is an unambiguous information that the ball on the tee has been used and the player needs another one. In one embodiment such determining means is a set of lasers intended to create a 3D space of the surroundings. The set of lasers at each movement of the arm scans the space between the beginning and the end of the arm to create a 3D image of the surroundings. Next the robot software analyses the 3D image created with the use of laser analysis and identifies the positions of the balls available on the tray. The site where the tee with the ball is positioned is also determined by the analysing software for the image provided from the set of lasers.

The set of lasers is preferably configured to be oriented automatically towards the golf ball. In one embodiment the set of lasers is positioned on the arm 1. The user, in one embodiment, manually orients the set of lasers towards the ball on the tee and these sensors determine whether the ball has been hit. If presence of the ball is not detected, then the software sends a command to the robot to set a new ball. The set of lasers, in this embodiment, requires manual setting. The new ball is set in 1 second after the stroke.

In another embodiment, the determining means is a camera which is configured to determine when the golf ball on the tee is hit. The camera monitors a position of the tee and controls whether there is the ball on it. The user does not set the camera manually. The software analyses an image from the camera and determines when the ball disappears from the tee. Then it sends a command to the robot to set a new ball. The new ball is set on the tee in about 5-6 seconds after the previous one is hit. In one example, the camera is secured on the arm 1 of the robot.

In one embodiment, in which the robot does not necessarily have determining means, the container 4 is preferably shaped in a manner to have the balls dropping from the same site from which the arm 1 is able to draw them. The software, upon indication of the site from which the ball is to be drawn and the site where the ball is to beset, repeats a movement. The movement of the robot, in this example, is made manually, preferably by means of a Bluetooth button. This is an energy-saving solution.

In one embodiment, the robot is provided with a second camera which is intended to monitor the movement of the player. The second camera records each movement of the player and his strokes. Then, by means of artificial intelligence, analysis of the movement is performed with indication of errors in each stoke and suggested corrections. Preferably, such information may be communicated to the player's phone. The present invention uses the set of lasers, cameras and artificial intelligence algorithms.

Another aspect of the disclosed embodiments is a method for setting golf balls that uses the above-described robot. The method comprises four steps:

a) configuring at least an initial position A from which the robot draws a golf ball and a final position B where the robot sets the golf ball, b) raising, by the robot, of the golf ball from the initial position A by means of the gripping element 3, c) conveying, by the robot, the golf ball to the final position B to force the golf ball out of the gripping element.

The arm 1 of the robot raises the ball from the initial position A and sets it on the tee—final position B. Raising of the ball is carried out, in this embodiment, by means of the suction element mounted preferably on the head 2. The suction element sucks to the ball due to the weight of the robot, and then the ball is forced over the tee in order to throw the ball out.

In one embodiment, step a) of configuring of the initial position A and the final position B is carried out though recording the movement of the arm 1 manually moved by the user. Upon pressing of a configuration button the robot is shown where it is supposed to draw the ball from—initial position A. Then the arm 1 of the robot is manually moved to a point above the tee where the ball is to be dropped—final position B. The resident software will make it possible to repeat the movement of the robot from point A to point B upon the user manually calling it in.

In one example, step a) of configuring of the initial position A and the final position B is carried out automatically, for example by means of at least one camera and through analysis of the obtained image by the resident software. It should be noted that the initial position A may be also programmed fixedly at the device manufacturing stage. In another embodiment, the user manually configures the initial position A and the final position B through the movement of the arm 1, i.e., manually guides the arm to the initial position A and then to the final position B.

The software may analyse the image from the camera and automatically set the ball on the tee, if the previous one has been hit. In this example, the user does not have to initiate this action by means of a button, the movement is executed automatically.

In a further embodiment, step a) of configuring of the initial position A and the final position B is carried out automatically by the set of lasers or cameras that creates the 3D image of the surroundings of the robot, and through analysing of the obtained image by the resident software. The robot is capable to recognize by itself the initial point A and the final point B without any input from the user. The arm 1 of the robot with the laser mounted thereon, upon actuation, will make a rotational movement by 180 degrees and will create the 3D image under the arm. The same applies to the camera. The resident software will analyse thus obtained image and will determine the positions of the tee on which the balls are to be set as well as the site for collecting balls from which the new ball is to be drawn. The position A preferably will be within the cavity of the container 4 or another site for storing balls, while the position B, determined by the laser, will be on the tee for balls. In another embodiment, the set of lasers needs to be configured manually by the user at the very beginning.

In another embodiment, after step c) step d) is executed of analysing play of the player by means of the set of lasers and the second camera, and obtaining results of analysis of golf ball stroke. The set of lasers creates a 3D image and the second camera is oriented towards the player and records his/her strokes. The recordings are provided to a software using artificial intelligence to analyse the strokes and provides the stroke analysis, shows errors and proposes corrections for the next stroke. The present invention uses the set of lasers, cameras and artificial intelligence algorithms.

The invention claimed is:

1. A robot for setting golf balls, comprising:

an arm, a head, connected to the arm, a controller, wherein on the head a gripping element is arranged capable to grip a golf ball, and the controller is provided with a software to enable movement of the golf ball to an indicated position; and a set of lasers provided on the arm, the set of lasers configured to to be oriented automatically towards the golf ball, create a 3D space of the surroundings and determine whether the golf ball set on a tee has been hit.

2. The robot for setting golf balls according to claim 1 wherein the arm has at least two articulated joints.

3. The robot for setting golf balls according to claim 1 wherein the gripping element is a gripper or a suction element.

4. The robot for setting golf balls according to claim 1 further comprising a camera that is configured to determine when the golf ball is hit.

5. The robot for setting golf balls according to claim 1 wherein the robot is equipped with a camera configured to monitor a movement of a player.

6. The robot for setting golf balls according to claim 1 further comprising a container configured to store golf balls on which the arm is secured.

7. The robot for setting golf balls according to claim 6 wherein the container gravitationally forces golf balls to a site of delivery from which the arm is configured to withdraw the golf balls.

8. A method for setting golf balls, using a robot comprising an arm, a head, connected to the arm, a controller, wherein on the head a gripping element is arranged capable to grip a golf ball, and the controller is provided with a software to enable movement of the golf ball to an indicated position; and a set of lasers provided on the arm, the set of lasers configured to to be oriented automatically towards the golf ball, create a 3D space of the surroundings and determine whether the golf ball set on a tee has been hit, the method comprising:

a) configuring at least once an initial position A from which the robot draws the golf ball and a final position B where the robot sets the golf ball, wherein configuring the initial position A and the final position B is carried out through recording a movement of the arm, b) raising, by the robot, of the golf ball from the initial position A by means of a gripping element, c) conveying, by the robot, the golf ball to the final position B to force the golf ball out of the gripping element.

9. The method of setting golf balls according to claim 8 wherein in step a) of configuring of the initial position A and the final position B is carried out automatically, by means of at least one camera and through analysing of an obtained image by a resident software.

10. The method of setting golf balls according to claim 8 wherein in step a) of configuring of the initial position A and the final position B is carried out automatically by a set of lasers or cameras which create a 3D image of the surroundings of the robot, and through analysing of an obtained image by a resident software.

11. The method of setting golf balls according to claim 8 wherein after step c) step d) is performed of analysing play of a player by means of a set of lasers and a second camera and obtaining results of an analysis of a golf ball stroke.

12. The robot according to claim 3, wherein the gripper and suction element comprises a silicon gripper and a silicon suction element.

* * * * *